US005136823A

United States Patent [19]

Pellegrino

[11] Patent Number: 5,136,823

[45] Date of Patent: Aug. 11, 1992

[54] DEVICE FOR CLADDING ARCHITECTURAL SHINGLES

[76] Inventor: John V. Pellegrino, 53 Cross Rd., Morris Plains, N.J. 07950

[21] Appl. No.: 640,549

[22] Filed: Jan. 14, 1991

Related U.S. Application Data

[63] Continuation-in-part of Ser. No. 398,447, Aug. 25, 1989, abandoned.

[51] Int. Cl.[5] ..... E04D 1/12

[52] U.S. Cl. ..... 52/539; 52/589; 52/591; 52/604

[58] Field of Search ..... 52/384–392, 52/589–595, 276, 278, 539, 604

[56] References Cited

U.S. PATENT DOCUMENTS

| | | | |
|---|---|---|---|
| 357,144 | 2/1887 | Buttler | 52/384 |
| 841,490 | 1/1907 | Du Montier | 52/591 |
| 1,064,091 | 6/1913 | Scheu | 52/589 |
| 1,895,801 | 1/1933 | Keller | 52/604 |
| 2,005,380 | 6/1935 | Marsh et al. | 52/292 |
| 2,672,831 | 4/1952 | Fink et al. | 108/8 |
| 2,682,236 | 3/1951 | Holstrom et al. | 108/17 |
| 2,693,102 | 11/1964 | Luster et al. | 52/392 |
| 2,851,134 | 9/1958 | Robinson | 52/385 |
| 2,895,181 | 6/1955 | Hope et al. | 20/5 |
| 4,034,528 | 7/1977 | Sanders et al. | 52/519 |

FOREIGN PATENT DOCUMENTS

| | | | |
|---|---|---|---|
| 237260 | 4/1964 | Austria | 52/391 |
| 520600 | 6/1953 | Belgium | 52/589 |

OTHER PUBLICATIONS

"Rigid Vinyl Siding Application", Vinyl Siding Institute, 1985, all pages.

*Primary Examiner*—James L. Ridgill, Jr.
*Attorney, Agent, or Firm*—Bernard J. Murphy

[57] ABSTRACT

A flat sheet, having nailing tabs on both sides or edges thereof is to be fastened directly onto existing clapboard or shingles. The tabs are so configured that juxtaposed panels can be interdigitated via the tabs, and the sheets obscure the nailing tabs. The panels have ledges in which to nest the lowermost course of the to-be-sheathed clapboard or shingles, and a stub projecting from one side of the sheets is slidably received by a juxtaposed panel to effect a linear alignment of the juxtaposed panels.

14 Claims, 1 Drawing Sheet

DEVICE FOR CLADDING ARCHITECTURAL SHINGLES

This application is a continuation-in-part of application Ser. No. 07/398,447, filed Aug. 25, 1989 now abandoned.

This invention pertains to exterior architectural surfacings for building structures, and in particular to a novel cladding panel for sheathing an exterior curtain formed of clapboard, shingles, or the like.

BACKGROUND

Description of Prior Art

The application of cladding type materials on exterior architectural surfaces is a mature technology. General availability of such products can be traced to the 1950s. The form that is usually followed is that the products attempt to create the appearance of genuine wood clapboards or shingles while diminishing the needs for periodic maintenance.

The commentary outline that follows gives a detailed description of the characteristics of currently available products with some relevant pros and cons included.

Materials of Manufacture—There are three materials currently in use in the manufacture of cladding products. They are steel, aluminum, and plastic. Except for some extremely rare applications, the grade of plastic used is polyvinyl chloride (PVC).

Weather Resistance—Good weather resistance is essential for any cladding product. Aluminum and PVC are naturally highly weather resistant materials. Most aluminum and PVC cladding manufacturers guarantee their products for 40 years. Steel, however, requires protection to prevent rusting.

The word 'shingles' is intended to mean any suitable imbricated surface.

Color Retention—The preferred method of maintaining color retention is to make the cladding elements out of a material that has the desired color completely through its thickness. In this way, any surface weathering simply exposes a fresh surface of new material from beneath which in turn maintains the color. This is precisely the technique associated with the use of PVC. Aluminum and steel, however, obtain their color from the application of paint. The paint has a limited useful lifetime and must be renewed when it has lost its effectiveness.

Installation—The customary technique for installing residing cladding products is a three step process. Each of the three steps uses nails as the fastening method. The first step involves the application of a course of predominantly vertically oriented series of furring strips (lumber boards with a $1\times2$ inch cross section). The second step involves the application of 'moulding like' elements which are fastened around the building's windows and doors and along the building's corners. These 'moulding like' elements provide a suitable frame for the finished siding as well as pocket-shaped recesses into which the edges of the siding units can fit. The third step is the actual installation of the siding units which is generally performed by starting at the lowest edges and working upward.

Thermal Expansion Considerations—The typical temperature extremes that siding products must endure vary between $-30°$ and $+45°$ Celsius. This variation can produce substantial levels of thermal expansion. This is especially true for PVC when it is installed in the customarily supplied 20 feet lengths. Under this condition, an expansion of 1 inch can be expected. This amount of expansion is more than enough to cause serious buckling. For this reason, the manufacturers instruct the installer to only loosely nail the product in place thus providing an avenue for unrestricted movement when expansions are encountered. The disadvantage of this is that the product is not ruggedly secured and usually rattles in high winds.

Vinyl and/or aluminum siding is available to the do-it-yourself homeowner. However, it is almost always professionally installed because it requires the use of special tools and skills. Too, such siding is not inexpensive. Vinyl and aluminum siding, when installed, occupies a position approximately two inches out from the original surfacing. This arises from the fact that such siding requires underlying furring strips. Consequently, window and door frames have to be trimmed outwardly to meet the siding, and this adds complication and cost. The vinyl and aluminum siding is subject to denting, from errant baseballs, fallen limbs, and the like, in that there obtains an open space therebehind, between the furring strips.

It is an object of this invention to set forth a cladding panel which is inexpensive, simple to install, requiring no furring strips, and which is resistant to impact damage.

It is particularly an object of this invention to disclose a cladding panel, for sheathing an exterior curtain formed of clapboard, shingles and the like, comprising a flat sheet having a front, decorative surface, and a rear, curtain-interfacing surface; wherein said surfaces are (a) bounded by rectilinear sides, top and bottom of said sheet, and (b) uninterrupted; first means, integral with said sheet, and extending from only sides thereof, for attaching said panel to an exterior curtain; second means, integral with said sheet, and extending from the bottom thereof, for nestably engaging a lowermost course of such exterior curtain; and third means, integral with said sheet, and extending from only one side thereof, for slidably engaging another, same, juxtaposed cladding panel, for effecting a linear alignment of both, so-juxtaposed panels.

Further objects of this invention, as well as the novel features thereof, will become more apparent from the following description taken in conjunction with the accompanying figures, in which.

Figures 1, 2, 3, 4, 5, 6:
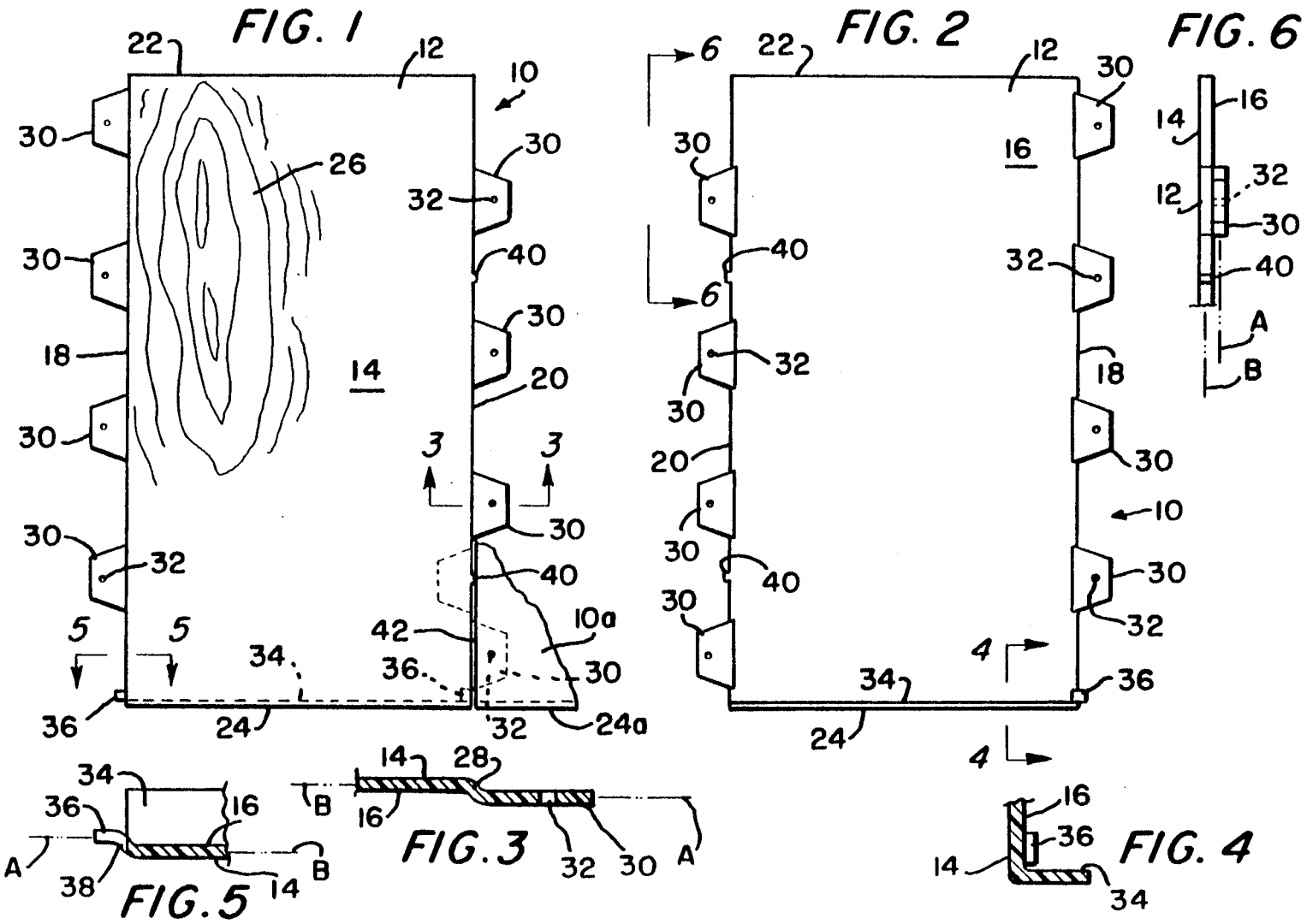
FIG. 1 is a front, elevational view of the front of a cladding panel according to an embodiment of the invention.
FIG. 2 is a rear, elevational view of the panel of FIG. 1.
FIG. 3 is an enlarged cross-sectional view taken along section 3—3 of FIG. 1.
FIG. 4 is an enlarged cross-sectional view taken along section 4—4 of FIG. 2.
FIG. 5 is an enlarged cross-sectional view taken along section 5—5 of FIG. 1.
FIG. 6 is a partial, end view taken along 6—6 of FIG. 2.

As shown in the figures, the novel cladding panel 10, according to an embodiment thereof, comprises a flat sheet 12 which has a front, decorative surface 14 and a rear, curtain-interfacing surface 16. The sheet is bounded by rectilinear sides 18 and 20, top 22 and bottom 24. Sheet 12 has wood-grain-simulated embossing 26 on surface 14, however sheet 12 has a continuous, uninterrupted form.

The material of which the panel 10 is formed is rigid polyvinyl chloride (PVC) plastic. This plastic material is colored completely through its thickness such that any surface weathering simply exposes a fresh surface of new material from beneath which, in turn, maintains the color. Furthermore, PVC plastic has excellent weather resistance which contributes favorably to a long service life.

Integral with the sheet 12, and joined thereto through bights 28, are tabs 30. The tabs 30 have holes 32 formed therein through which to receive fasteners, such as nails, and the tabs extend only from sides 18 and 20 of the sheet 12. Too, tabs 30 on one of the sides of the sheet 12 are spaced, horizontally, from tabs 30 on the opposite side of the sheet. This is so that a first panel 10 can be interdigitated with another, same, juxtaposed panel 10.

Also integral with the sheet 12, and extending perpendicularly from surface 16, is a straight ledge 34. The latter is provided for nestingly engaging the lowermost course of such clapboard or shingling of the exterior curtain to which the cladding panels 10 are fastened. A small stub 36, extending through another bight 38 from side 18, is provided for linearly aligning a juxtaposed panel 10 with a first thereof. In FIG. 1 there is shown a fragment of such a juxtaposed panel 10*a*. The stub 36 thereof is received, and hence confined, by the ledge 34 and the lowermost tab 30 on side 20 of panel 10. It is this reception and confinement which linearly aligns the bottoms 24 and 24*a* of panels 10 and 10*a*. The stub 36 is received, slidably, against surface 16 in that it subsists in a plane "A", whereas the sheet 12 subsists in a plane "B". Similarly, the tabs 30 subsist in the same plane "A" so that, as they are interdigitated with a juxtapositioned panel, they will be obscured from the front; only surfaces 14 will be visible.

Along only one side, side 20, are minute projections 40. The same are provided to define a small gap 42 between juxtapositioned panels 10 (and 10*a*), and to absorb the effect of thermal expansion of the panels. The extent of the projections 40, and hence the width of the gaps 42, are but fifteen-thousandths of an inch. As the panels expand, thermally, the projections 40 simply flatten out, and buckling of the panels themselves is thereby avoided.

The panels 10 are supplied in a height dimension which complements the same dimension of the clapboard, shingles, or the like, which are to be cladded. If an exact match cannot be made, the next larger size of panels 10 are obtained and trimmed to the required dimension by cutting off as much of the top of the panel as is required. Note that, as there are such pluralities of tabs 30, more than half of a panel 10 can be removed from the top, and there will still be tabs on each side of the trimmed panel for fastening purposes.

A first panel 10 is installed at either end of the lowest course of the to-be-sheathed curtain. It is set up against the lowermost portion of the curtain, to nest the latter in the ledge 34, and it is then nailed in place directly onto the curtain by use of the tabs 30 on sides 18 and 20. A next panel (10*a*) is juxtaposed thereto, with the tabs 30, on the abutting side thereof, slid therebehind and interdigitated with the tabs 30 on the first panel. Too, the stub 36 is simultaneously fitted between the lowermost tab 30 and the ledge 34 of the first panel to insure that the bottoms 24 and 24*a* are linearly aligned. The second, juxtaposed panel is nailed in place, by using the exposed tabs 30 on the other side thereof. The course is completed by installing additional panels in juxtaposition to the priorly-installed ones. This continues on a course by course basis to sheath the whole curtain. Abutments, such as window and door frames are met with trimmed panels, and course ends and/or corners are to be covered with right-angular plastic, color-matched and cemented in place.

While I have described my invention in connection with a specific embodiment thereof, it is to be clearly understood that this is done only by way of example, and not as a limitation to the scope of my invention as set forth in the objects thereof and in the appended claims.

Some of the newly conceived features which make this invention unique are:

the use of a plurality of self concealing side tabs which provide a simple attachment means and a method of interlocking the panels together.

the way in which the problem of thermal expansion was solved.

the simplification of the installation routine which eliminated the necessity of furring strip supports and surrounding mouldings.

the incorporation of a true wood grain surface on the face of the panel.

I claim:

1. A cladding panel, for sheathing an exterior curtain formed of clapboard, shingles, and the like, comprising: a flat sheet having a front, decorative surface, and a rear, curtain-interfacing surface, wherein said surfaces are (a) bounded by rectilinear sides, top and bottom of said sheet, and (b) uninterrupted;

first means, integral with said sheet, and extending from only sides thereof, for attaching said panel to an exterior curtain;

second means, integral with said sheet, and extending from only the bottom thereof, for nestably engaging a lowermost course of such exterior curtain;

third means, integral with said sheet, and extending from only one side thereof, for slidably engaging another, same, juxtaposed cladding panel, for effecting a linear alignment of both, so-juxtaposed panels;

said sheet subsists in a first plane;

said first means terminates, outwardly from said sheet, in a second plane which is parallel with said first plane; and further including means integral with said sheet, and extending from only one side thereof, for (a) slightly spacing such a juxtaposed panel from said sheet, and (b) absorbing any thermal expansion of such so-juxtaposed panels.

2. A cladding panel, for sheathing an exterior curtain formed of clapboard, shingles, and the like, comprising:

a flat sheet having a front, decorative surface, and a rear, curtain-interfacing surface, wherein said surfaces are (a) bounded by rectilinear sides, top and bottom of said sheet, and (b) uninterrupted;

first means, integral with said sheet, and extending from only sides thereof, for attaching said panel to an exterior curtain;

second means, integral with said sheet, and extending from the bottom thereof, for nestably engaging a lowermost course of such exterior curtain; and third means, integral with said sheet, and extending from only one side thereof, for slidably engaging another, same, juxtaposed cladding panel, for effecting a linear alignment of both, so-juxtaposed panels.

3. A cladding panel, according to claim 2, wherein:
said first and second means comprise means cooperative for confining therebetween said third, alignment means of such a juxtaposed panel.

4. A cladding panel, according to claim 2, wherein:
said first means comprises tabs; and
said tabs have holes formed therein through which to receive fasteners.

5. A cladding panel, according to claim 2, wherein:
said first means comprises pluralities of tabs extending from both sides of said sheet; and
said tabs have holes formed therein through which to receive fasteners.

6. A cladding panel, according to claim 5, wherein:
said tabs are joined to said sheet through bights.

7. A cladding panel, according to claim 2, wherein:
said third means comprises a stub.

8. A cladding panel, according to claim 2, wherein:
said stub is joined to said one side of said sheet through a bight.

9. A cladding panel, according to claim 2, wherein:
said sheet subsists in a first plane; and
said first means subsists in a second plane which is parallel with said first plane.

10. A cladding panel, according to claim 9, wherein:
said third, alignment means subsists in said second plane.

11. A cladding panel, according to claim 9, wherein:
said second means comprises a ledge which is substantially perpendicular to said first plane.

12. A cladding panel, according to claim 2, further including:
means integral with said sheet, and extending from only one side thereof, for (a) slightly spacing such a juxtaposed panel from said sheet, and (b) absorbing any thermal expansion of such so-juxtaposed panels.

13. A cladding panel, according to claim 12, wherein:
said sheet subsists in a given plane; and
said spacing and expansion-absorbing means subsists in said same, given plane.

14. A cladding panel, according to claim 12, wherein:
said spacing and expansion-absorbing means comprises minute projections.

* * * * *